US009233315B2

(12) United States Patent
Fredriksson

(10) Patent No.: US 9,233,315 B2
(45) Date of Patent: Jan. 12, 2016

(54) MODEL VEHICLE REMOTE CONTROL SYSTEM

(71) Applicant: Lars-Berno Fredriksson, Kinna (SE)

(72) Inventor: Lars-Berno Fredriksson, Kinna (SE)

( * ) Notice: Subject to any disclaimer, the term of this patent is extended or adjusted under 35 U.S.C. 154(b) by 0 days.

(21) Appl. No.: 14/273,888

(22) Filed: May 9, 2014

(65) Prior Publication Data

US 2014/0249697 A1 Sep. 4, 2014

Related U.S. Application Data

(62) Division of application No. 13/676,348, filed on Nov. 14, 2012, now Pat. No. 8,874,282.

(51) Int. Cl.

| | |
|---|---|
| ***G05D 1/00*** | (2006.01) |
| ***G05D 3/00*** | (2006.01) |
| ***A63H 30/04*** | (2006.01) |
| ***A63H 27/00*** | (2006.01) |

(52) U.S. Cl.
CPC ..... *A63H 30/04* (2013.01); *A63H 27/02* (2013.01)

(58) Field of Classification Search
USPC ..... 701/2, 11
See application file for complete search history.

(56) References Cited

U.S. PATENT DOCUMENTS

| | | | | |
|---|---|---|---|---|
| 6,633,800 | B1 * | 10/2003 | Ward et al. | 701/2 |
| 8,452,464 | B2 | 5/2013 | Castaneda et al. | |
| 8,473,140 | B2 | 6/2013 | Norris et al. | |
| 2006/0058928 | A1 * | 3/2006 | Beard et al. | 701/11 |
| 2006/0072531 | A1 | 4/2006 | Ewing et al. | |
| 2006/0192663 | A1 | 8/2006 | Bryan et al. | |
| 2009/0167308 | A1 * | 7/2009 | Lomes | 324/326 |
| 2010/0145551 | A1 | 6/2010 | Pulskamp et al. | |
| 2011/0266076 | A1 * | 11/2011 | Morey et al. | 180/9.32 |
| 2012/0175427 | A1 * | 7/2012 | Feldman et al. | 239/2.1 |

* cited by examiner

*Primary Examiner* — Thomas G Black
*Assistant Examiner* — Tyler Paige
(74) *Attorney, Agent, or Firm* — C. John Brannon; Brannon Sowers & Cracraft PC

(57) ABSTRACT

Methods, systems, and apparatus for remotely piloting a vehicle. In one aspect, a system includes a transmitter capable to receive vehicle control signals and transmit the vehicle control signals to a vehicle including at least one receiver; one or more modules; and at least one power supply; wherein the at least one receiver receives the transmitted vehicle control signals and transmits the vehicle control signals in a CAN message format to all of the one or more modules; and each of the one or more modules selectively chooses which of the vehicle control signals in a CAN message format the module will respond to.

20 Claims, 7 Drawing Sheets

CANbus 2 Model Vehicle

MODEL VEHICLE REMOTE CONTROL SYSTEM

CROSS-REFERENCE TO RELATED APPLICATIONS

This patent application is a divisional of co-pending U.S. patent application Ser. No. 13/676,348, filed on Nov. 14, 2012.

BACKGROUND

This specification relates to the remote control of model vehicles and more specifically to the remote control of vehicles utilizing controller area network enabled control devices.

Remote control systems such as systems that can be found in remote control models (RC model), can be thought of as consisting of three major parts, a transmitter, one or more receivers and one or more actuators (servos). The transmitter transmits the control signals while the one or more receivers receive the control signals and relay the signals to servos accordingly. The servos, in response to a signal, perform some action. For example, a transmitter used to control a RC model plane may transmit a control signal that contains the information to increase the angle of elevation of an aileron on the RC model plane. In this example a receiver would receive the control signal and then relay the signal to the appropriate servo. The servo would then actuate to increase the angle of the aileron.

In some implementations, the transmitter has a microcomputer by which input signals from input devices, such as joysticks, pushbuttons, potentiometers, computing devices, and the like, can be mixed and manipulated. For example, linear input signals can be translated into non-linear signals, input signals can be thresholded, and the like. Similarly, in some implementations, one or more receivers can also have a microcomputer by which received control signals are translated into control signals appropriate for a specific servo. For example, a received control signal may be translated and thresholded into a control signal less than or equal to the maximum value permitted by the controlled servo. In some implementations, signal translation, either by the transmitter or the receiver, is based upon data derived from specific models. For example, control signals transformed based upon data from one size of a scale model may be transformed differently for another size of scale for the same model. The selection of the wrong model is often the cause of a crash of a RC model plane. This is common problem with model specific data stored in the transmitter is known as the Wrong Model Syndrome or WMS by RC model enthusiasts. That is, a Before controlling a vehicle, the pilot has to select the right model from a list of the stored ones in the transmitter. Selecting the wrong one usually results in a crash. The problem is even greater for some existing technologies where similar data can be stored both in the transmitter and the receiver. In this case, a mismatch can lead to a crash even if the selected model at the transmitter is correct.

As the complexity of the remotely controlled vehicle increases, so does the number of servos. This can create a situation where complex wiring and communication schemes are needed. RC model vehicles with 50 or more servos are not unheard of. If the servos are digitally addressed, the bus for communication between the receiver and servos likely has eight signal paths just for addressing the servos. Similarly, transmitters holding the specifications for 50 different models are also not unheard of, leading to complexities in management of model information. Thus, there is a need for a system to remotely control vehicles utilizing controller area network enabled control devices. The present invention addresses this need.

SUMMARY

This specification describes technologies relating to a remote control device and a controller area network in conjunction with microcontrollers and devices such that the microcontroller and devices can communicate with each other without a host computer.

In general, one innovative aspect of the subject matter described in this specification can embodied a system that includes a transmitter that is able to receive vehicle control signals and transmit the vehicle control signals; a vehicle that includes a receiver, one or more modules, and a power supply; wherein the receiver receives the transmitted vehicle control signals and then transmits the vehicle control signals in a CAN message format to all of the one or more modules and wherein each of the one or more modules selectively chooses which of the vehicle control signals in a CAN message format the model will respond to.

These and other embodiments can each optionally include one or more of the following features. The transmitter can be configured to translate received vehicle control signals into a CAN message format before transmitting the vehicle control signals. Each of the one or more modules can receive and store a scheme. Each of the one or more modules can engage in transmission of CAN messages. Each of the one or more modules can have an additional data interface. Each of the one or more modules can self-configure through the interrogation of one or more of the other modules connected to a common CAN bus within the vehicle. Each of the one or more modules can supplement a continuous power supply through a distributed power scheme. Each of the one or more modules can recharge its power supply using power from a continuous power supply.

Particular embodiments of the subject matter described in this specification can be implemented so as to realize one or more of the following advantages. Because the modules require only a simple bus, the wiring of the modules within a remote controlled vehicle is less costly in terms of time, materials, and complexity. Modules can more readily be reused from one remote control vehicle to another since a module can be configured to operate in accordance to a supplied scheme. Because modules can be regulated and supply their own power through a distributed scheme, the risk of deep discharge of rechargeable power sources is reduced. Modules can be embedded into servos or controllers to further reduce wiring and number of connectors. Systems design is exceedingly simplified as PC based tools can be temporarily connected to the bus together with the transmitter and the model vehicle together. As any model specific information is stored in the model and any signal modification and mixing will be executed there, system dependability is brought to a high level, totally removing the WMS.

Further, in some implementations modules can be embedded into servos or controllers to further reduce wiring and number of connectors. Systems design is exceedingly simplified as PC based tools can be temporarily connected to the bus together with the transmitter and the model vehicle. As any model specific information is stored in the model and any signal modification and mixing will be executed there, system dependability is brought to a high level, eliminating the WMS (Wrong Model Syndrome).

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
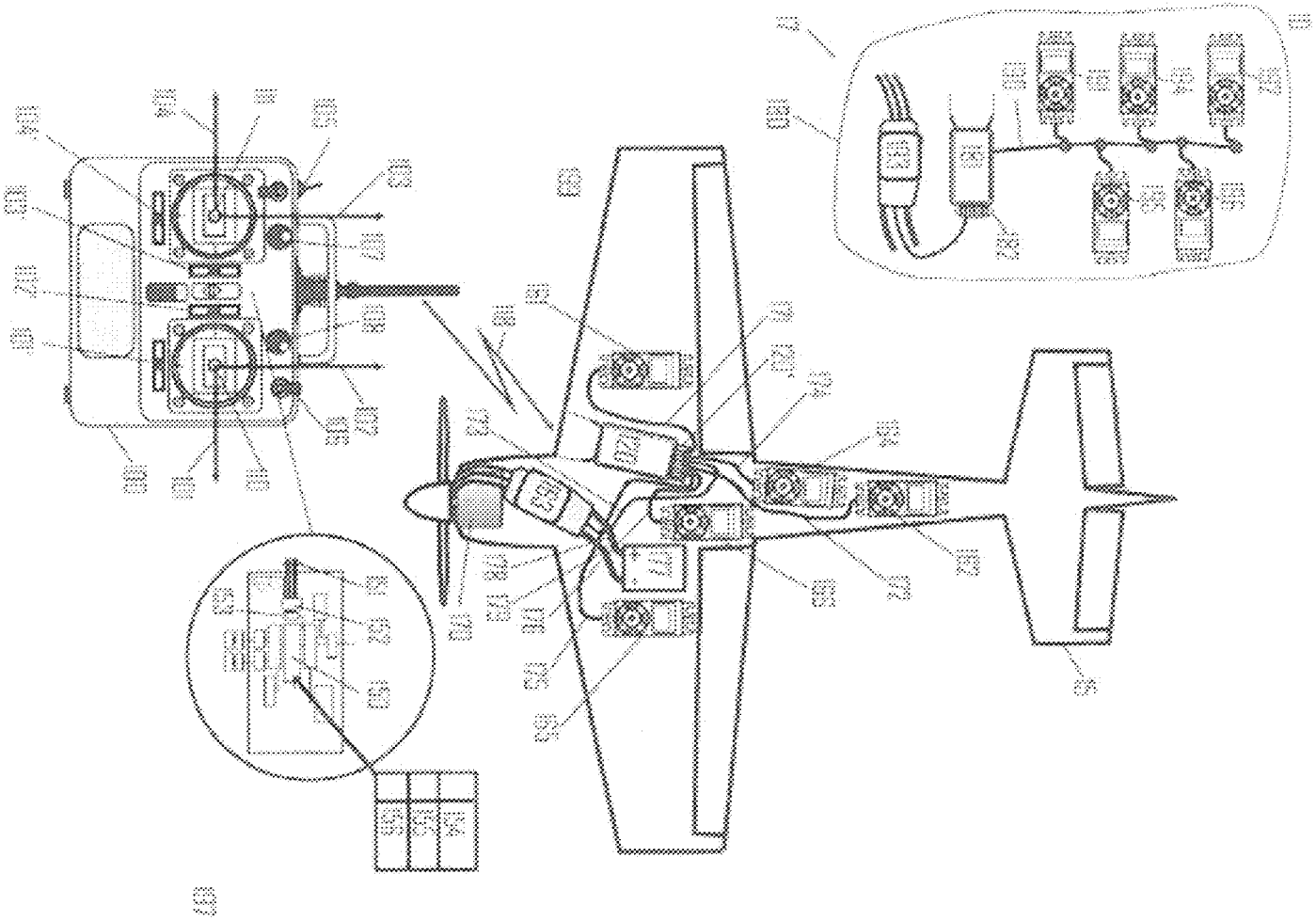
FIG. 1 is an example of a remote control system implemented in a flying vehicle.

Before the present methods, implementations and systems are disclosed and described, it is to be understood that this invention is not limited to specific synthetic methods, specific components, implementation, or to particular compositions, and as such may vary. It is also to be understood that the terminology used herein is for the purpose of describing particular implementations only and is not intended to be limiting.

As used in the specification and the claims, the singular forms "a," "an" and "the" include plural referents unless the context clearly dictates otherwise. Ranges may be expressed in ways including from "about" one particular value, and/or to "about" another particular value. When such a range is expressed, another implementation may include from the one particular value and/or to the other particular value. Similarly, when values are expressed as approximations, for example by use of the antecedent "about," it will be understood that the particular value forms another implementation. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not. Similarly, "typical" or "typically" means that the subsequently described event or circumstance often though may not occur, and that the description includes instances where said event or circumstance occurs and instances where it does not.

A controller area network (CAN bus or CAN) is an ISO 11898 bus standard that enables controllers, such as microcontrollers, and devices to communicate with each other without a host computer. Only the briefest discussion of CAN bus communication will be provided here. A more extensive coverage can be found in referencing the ISO 11898 or patents that make use of CAN bus technology. For example, one patent that makes use of CAN bus technology is the U.S. Pat. No. 6,467,039.

CAN is multi-master broadcast based standard, often implemented serially, where each device, microcontroller, and the like is enabled to send and receive messages. In some implementations, messages consist of an identifier (ID) which represents a priority of a message and data. For example, in some implementations the data can be up to eight data bytes. In some sensor and control application, data can consist of twelve bits (yielding 4096 discrete values).

In a CAN network, all nodes (devices attached to or communicating via the network) receive all messages, and any response to a transmitted message can be distributed. That is, the nodes each individual decide to what message they will respond and how they will respond. Thus, a message can result in two or more nodes engaging in activity. When the bus is free, any node may begin to transmit. In the event of a message collision, the more dominant message (higher priority) overwhelms the less dominant message. In some implementations, the network is implemented as a standard bus topology. A bus topology is a network architecture in which a set of clients (nodes) are connected via a shared communications line, called a bus. In some implementations, the network is implemented as a star network. A star network consists of a central node, to which all other nodes (modules) are connected.

FIG. 1 is an example 10 of an implementation of a remote control system implemented in a flying vehicle 199. The example 10 shown suggests an airplane model, but implementations are similar for other model vehicles such as helicopters, cars, boats, and the like. The example 10 includes a transmitter 100, a receiver 120, a motor controller 163 and a number of servos 161, 162, 164, 165 and 166. The motor controller 163 controls the speed of the motor. The transmitter 100 has two joysticks, joystick 110 and joystick 111. While this example 10 utilizes a transmitter having two joysticks, the disclosed system can, of course, be configured to work with transmitters of different configurations. For example, the disclosed system can be configured to work with a transmitter having a single joystick, a trackball, a steering wheel, pressure sensitive directional controls, and the like. Joystick 110 controls the axes 103 and 104 while joystick 111 controls axes 102 and 101 with each joystick adjusting its respective axes. The transmitter 100 has switches 105 and 106 for controlling modes, digital controls such as landing gear and the like. The transmitter 100 has potentiometers 107 and 108 for semi static controls as flaps and gain.

In this example, the pilot generates control signals by manipulating the joysticks 110, 111, and other controls 105 to 108. Also in this example, the axis 101 refers to the ailerons, axis 102 refers to elevator, axis 103 to motor control and axis 104 to rudder. Switch 105 controls flaps while switch 106 controls landing gear. Signals generated by manipulation of the controls are read by microcontroller 150 housed within the transmitter 100. Signals are propagated to microcontroller 150 through cables 151. That is to say that the cables 151 connect to the various controls. This example includes a multiplexer 152 and an analog to digital converter 153. Signals are manipulated and mixed by the microcontroller 150 according to one of the schemes, also known as models 154, 155 or 156. For example, each scheme can represent a different model vehicle and can set model specific parameters for the manipulation and mixing of pilot generated control signals. Mixing and manipulation of the control signals can also include splitting a control signal into two separate signals. For example, a control signal generated by manipulating the joystick 110 along the 101 axis (aileron) can be split into two signals, a signal for the left aileron, manipulated by the servo 165, and a signal for the right aileron manipulated by the servo 161.

The flying vehicle 199 houses a motor controller 163 and servos 161, 162, 164, 165 and 166. Manipulated and mixed pilot input signals are transmitted by radio transmission 118 to the receiver 120. The receiver 120 is connected to the motor controller 163 and respective servos 161, 162, 164,165 and 166 by a combined three conduit connection 171, 172 173, 174, 175 and 176. The connections feed the motor controller 163 and each respective servo with power and control signal. In this example 10, power is supplied from a battery 177 connected to the motor controller 163 via the cables 178 and 179. The battery voltage is typically chosen to match the requirements of the motor 170. The motor controller 163 provides power at a reduced voltage via the connection 173 to the receiver 120 which in turn feed the rest of the system. For example, in some implementations the motor controller 163 can supply power at a voltage of 5-6 volts.

For the sake of completeness, example 10 includes a second possible implementation 190 where the flying vehicle would house a motor controller 193, servos 191 to 196 and receiver 181. The connection is implemented upon a serial bus 182. Unlike the above implementation that makes use of pulse width modulation (PWM) signals, the receiver 181 transmits messages with a control value to the respective servo/controller. However, the underlying process is the same in both implementations; a transmitter 100 sends control signals to a servo or motor controller via receiver 181 or receiver 120.

Figure 2:
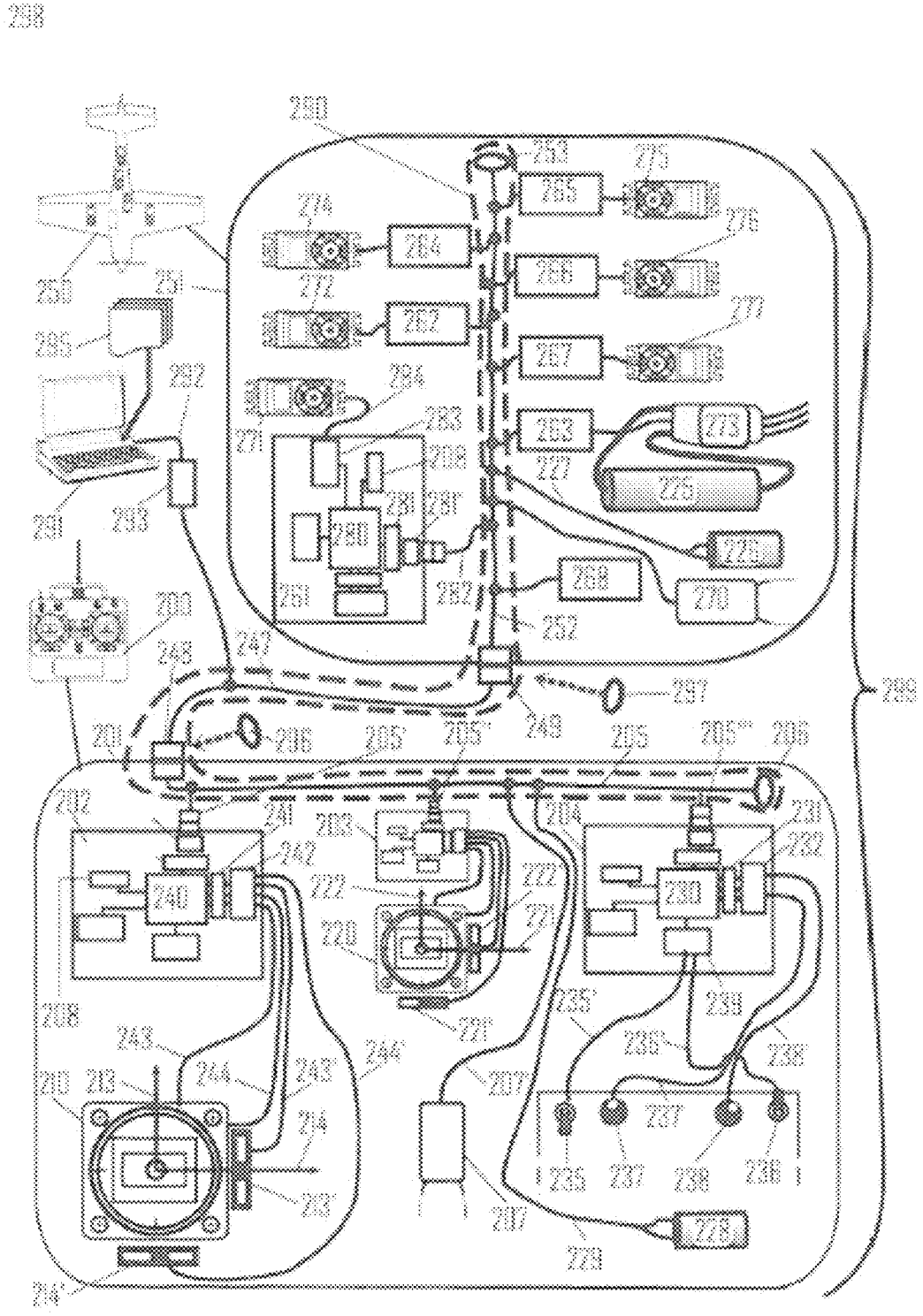
FIG. 2 is an example of an implementation of a controller area network (CAN) enabled remote control system implemented in a flying vehicle.

FIG. 2 is an example 298 of one possible implementation of a controller area network enabled remote control system 299 utilizing a flying vehicle 250. The system 299 includes the transmitter 200 and the model vehicle 250. The interior system of the transmitter 200 and model vehicle 250 is schematically shown as 201 and 251 respectively. Power is supplied to the transmitter system 201 by a regulated power source 228 depicted as a battery 228 connected with a twisted wire pair 229 running in parallel with the CAN bus 205. In the transmitter system 201, the sensors in the transmitter 200 are connected to separate modules 202, 203 and 204. These modules are in turn connected to a CAN bus 205 via the connections 205', 205" and 205'". A CAN bus is an architecture in which communicating or data producing elements are connected via a shared communication line, called a bus. A radio transceiver 207 is connected to the CAN bus 205 via the connection 207'. The module 202 is operationally connected to the joystick 210. The module 203 is operationally connected to the joystick 22. Module 204 is operationally connected to the switches 235 and 236 and is also connected to the potentiometers 237 and 238. In this example, the CAN bus 205 is terminated by the resistor 206.

The module 202 has a microcontroller 240 along with an A/D converter 241 and a multiplexer 242. The joystick 210 axis sensor 213 is connected to the multiplexer 242 by the connection 243. Similarly, the associated trimmer 213' is connected to the multiplexer 242 by the connection 243'. The axis sensor 214 axis is connected to the multiplexer 242 by the connection 244. The associated trimmer 214' is similarly connected to the multiplexer 242 by the connection 244'. Similar to joystick 210, the joystick 220 with its axes 221 and 222 and associated trimmers 221' and 222' are similarly connected to the module 203. Switches 235 and 236 are connected, through connections 235' and 236', to the digital I/O interface 239 of the microcontroller 230 in the module 204. The potentiometers 237 and 238 are, through connections 237' and 238', connected to the multiplexer 232 and the A/D converter 231 of the microcontroller 230. In some implementations, modules 202, 203, and 204 are, for all practical purposes, identical. Each module receives the values of its respective pilot control inputs and translates the pilot control inputs into a CAN message that contains the respective pilot control inputs. For example, module 202 receives the values of the joystick 210 and the associated trimmer 213 and axis sensor 214 and expresses the values in one or more CAN messages.

In some other implementations, the A/D converter 231 and a multiplexer 232 of module 204 are simpler than the respective A/D converters and multiplexers of the other modules. However, in other implementations, there is only a single module (not shown) that is shared among the entire pilot input devices. In some of these implementations, the single module is time shared and the module periodically samples the grouped pilot input devices. That is, the single module samples the state of joystick 210 (and associated controls) and expresses the state of joystick 210 (and associated controls) as a CAN message. The module then samples the state of joystick 220 (and associated controls) and expresses the state of joystick 220 (and associated controls) as a CAN message. The module then samples the state of control inputs 235, 237, 238, and 236 and expresses the state of these controls as a CAN message. The process then repeats. This sampling can be very rapid with 100 times per second not unheard of. Still, in other implementations, all three clusters of pilot input devices are simply multiplexed into the single module (not shown).

The CAN bus 205 of the transmitter system 201 is operationally connected to the CAN bus 252 of the model vehicle 250. Together, the CAN bus 205 of the transmitter system 201 and the CAN bus 252 can logically be thought of as the common CAN bus 290 which is depicted as a dashed line. In practice, the operational connection is achieved through the radio transceivers 270 and 207. For example, the radio transceivers 270 and 207 can be 2.45 GHz radio transceivers. However, some implementations allow for either a physical or radio connection to be used. Such physical connections enable the pilot to verify that the system is correctly set by connecting to a transmitter 729 and physically manipulating the transmitter controls to see that the model servos is responding correctly by directly observing the movements of the rudders, the motor rev, flaps, gear, etc., in response to the manipulation of the respective input organs of the transmitter 200. Alternatively, such physical connection can be used as a direct remote control method. For example, some implementations can use a wired connection similar to wired connection 247 to remotely pilot a scale model car (not shown).

The model vehicle subsystem 251 includes the CAN bus 252 to which modules 261, 262, 263, 264, 265, 266, 267, 268, and the radio transceiver 270 are connected. Note, in this example, the modules 261, 262, 263, 264, 265, 266, 267 and 268 are shown separate from the servos 271, 272, 274, 275, 276 and 277 as well as the motor controller 273. The motor controller 273 is supplied power by a power source 225, depicted as a batter 225 in example 298. The model system 251 is powered by regulated power source 226 depicted as a battery 226 in example 298. Power is carried by a twisted wire pair 227 that in some implementations is parallel to the CAN bus 252. In some implementations, the servo and module are one and the same and are housed within a single construction.

In some implementations, a CAN bus can be configured with a bus terminator. In this example, the bus terminators are shown as 253, 296, 297, and 206. In some implementations, a bus terminator can be used to prevent signal reflection and to help ensure that the CAN bus properly transmits signals.

In this implementation a module, like module 261 for example, has a microcontroller 280 that is connected to the CAN bus via the CAN controller 281, the CAN transceiver 281' and the connection 282. A servo, servo 271 for example, is connected to the PWM output 283 of the microcontroller 280 through the connection 284. In some implementations, a module can have additional data interfaces. For example, the module 261 can have a Universal Serial Bus (USB) 2.0 or 3.0 interface, an IEEE 1394 interface (FireWire™), or the like. The data interface is shown in FIG. 2 as 208. USB is a well-known and studied interface and will not be discussed within this application. Similarly, the IEEE 1394 interface is a well-known and studied interface and will not be discussed within this application. In some implementations, the additional data interfaces can be used to directly connect a module to another device, such as a computer. Such connected devices can then be reprogrammed, run through various diagnostics, and/or repurposed by the device. For example, the device such as a computer could run a diagnostic on the module producing a diagnostic report for the user to review.

In this example 298, a computer 291 is shown operationally connected to the logical CAN bus 290 through USB connection 292 to the CAN interface 293. The computer 291 can be also operationally connected to one or more webpages 295. The computer 290 can send and receive CAN messages. In some implementations, the computer's messages can include messages to reprogram the modules, to store new schemes in the modules, and the like. For instance, a pilot could reprogram the modules, enabling the modules to appropriately respond to CAN messages that previously the modules would have ignored. Additionally, the ability to program the modules enables a decoupling of the transmitter 200 and its pilot command encoding scheme from the modules, providing enhanced reusability of the modules and/or transmitter 200.

Figure 3:
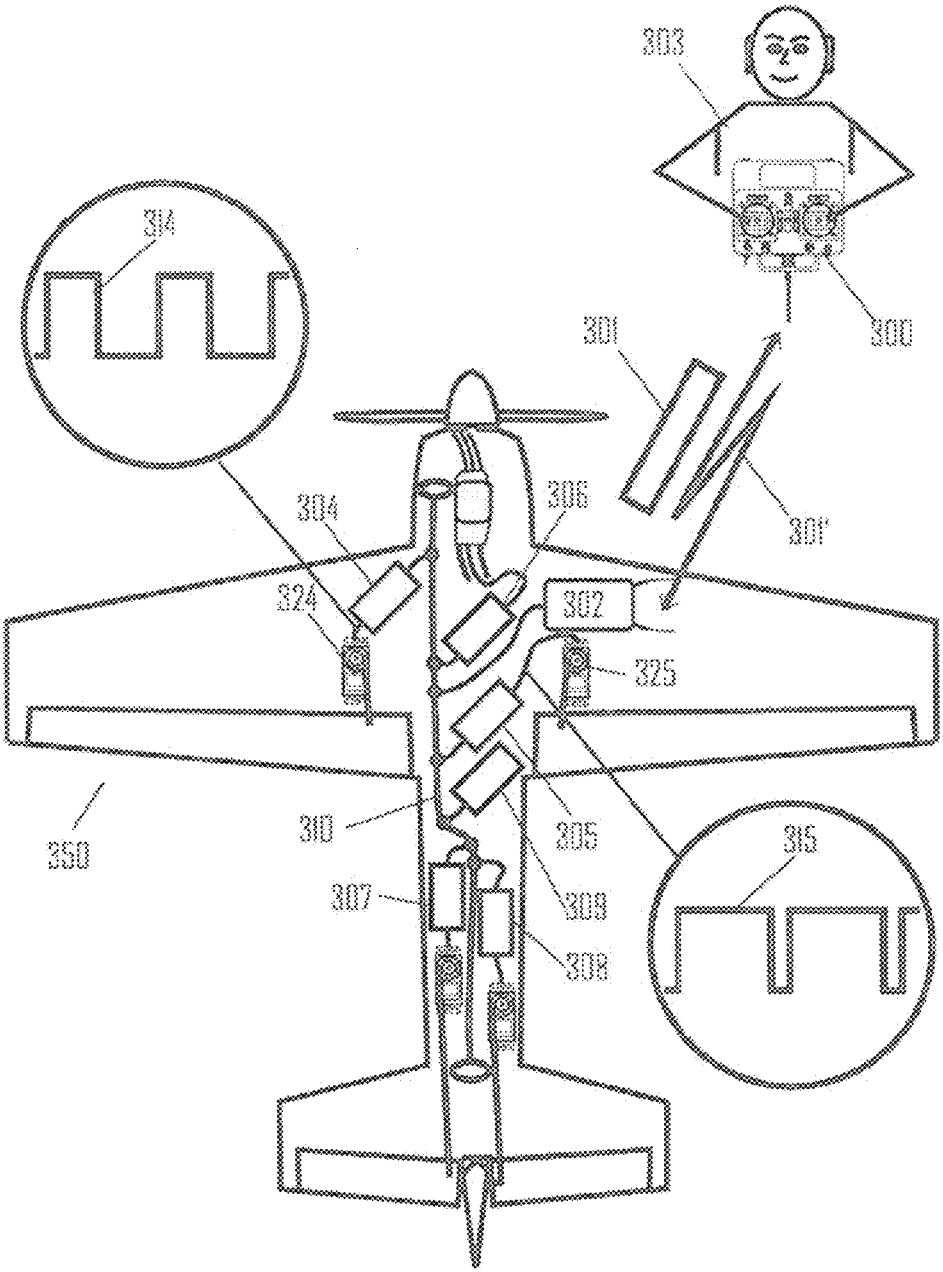
FIG. 3 is another example implementation of a CAN enabled remote control system implemented in a flying vehicle.

FIG. 3 is another example 399 of an implementation of a CAN enabled remote control system 398 implemented in a flying vehicle 350. The flying vehicle 350 is drawn to include two numbered modules 324 and 325. In this example 399, the modules 324 and 325 are shown to implement a digital signal 314 and 315 respectively. The pilot 303 manipulates the controls of the transmitter 300. The pilot's commands are turned into CAN messages internally by the transmitter 300 and transmitted embedded in a radio protocol information package 301 by radio signals 301'. The transmitter packages 301 are received by the radio transceiver 302. The radio protocol information and the associated technology is explained in detail in the U.S. Pat. No. 6,467,039 B1. The radio transceivers, shown in FIG. 2 as 207 and 270, act as a conduit for the CAN messages between the transmitter 300 and the model vehicle 350.

Figure 4:
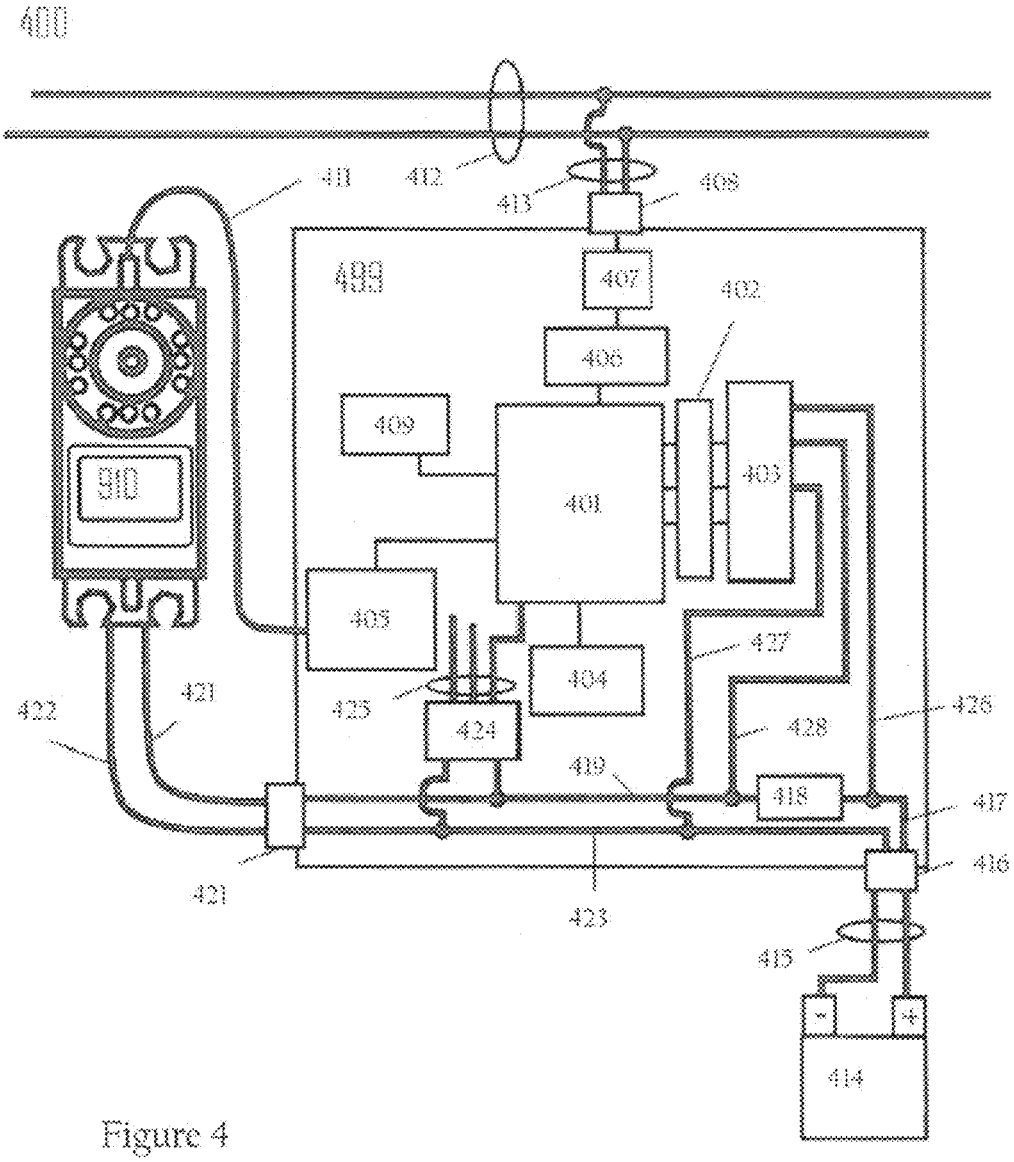
FIG. 4 is a block diagram of an example implementation of a module.

FIG. 4 is a block diagram 400 of an example implementation of a module 499. The module 499 has a microcontroller 401, an A/D converter 402 with a multiplexer 403, a digital I/O 404, a PWM output unit 405, a CAN controller 406, a CAN transceiver 407 and a CAN connector 408. Some implementations can include other IO interfaces such as a USB connector, a Bluetooth Low Energy transceiver, and the like symbolized as 409. The PWM output is connected to the servo 410 by the connection 411.

In some implementations, the microcontroller 401 includes a microprocessor with a random or serial access memory array or device, or a combination of one or more of them enabling data processing operations to be performed by the module 499. For example, such implementations can, in addition to being able to interpret and compose CAN messages and to selectively choose which messages to respond to, receive and store schemes. The module 499 can then use a stored scheme to process a received CAN message and respond accordingly. For example, the microcontroller 401 can truncate a value in a received message, based upon a stored scheme, in order to limit the range of motion of the servo 410. Such implementations can also provide for the ability to initiate a test phase where the module 499 records its performance and the performance of the other modules 499. Such recorded information can include a list of all the CAN messages received during the test phase, which CAN messages during the test phase the module 499 responded to, what CAN messages had to be retransmitted, which CAN messages were not responded to, operating parameters, such as voltage and current levels during the test phase, and the like.

In some implementations, the modules 499 function in a distributed computation manner. That is, every module 499 receives every CAN message sent on the CAN bus that the modules 499 are attached to. Each module 499 determines how it will respond to each CAN message. The modules 499 can have sufficient memory in the microcontroller 401 to enable a module 499 to store schemes, store messages, and store its operating parameters and even the operating parameters of the other modules 499 connected to the CAN bus. As an example, some of these implementations also allow for the modules 499 to query and gather information from other modules 499. This enables the modules 499 to learn of a faulty module 499, to disseminate operation characteristics of the model the modules 499 are in, to receive instructions for new CAN message formats, and the like. For example, a user could program one module 499 with the scheme for the entire model that the module and possibly other modules 499 occupy. The user could then send a message instructing all or part of the modules 499 to exchange information, enabling the other modules to acquire the scheme. Similarly, a new module 499, for example a replacement module, can be plugged into an existing implementation and acquire its needed information, such as the scheme, through interrogating the other modules 499. In this way, a module 499 can be self-configuring.

The CAN transceiver is connected to the CAN bus 412 via the connector 408 and the connection 413. The module 499 is connected to a power source 414 by the connection 415 and the connector 416. For example, in some implementations the power source 414 is a batter. In this example, power is supplied from the module 499 to the servo 410 through the connector 420 and the connection 421. However, some implementations are configured such that the servo 410 is powered directly by a power source that can be internal to the servo 410.

In this example 400, power flows through the connection 417. The power flows through a resistor 418 and continues through connection 419, through the connector 420 and the connection 421 powering the servo 410. The circuit is completed by the connection 422, the connector 420, the connection 423, the connector 416 and the connection 415. In this example, the module 499 is powered via the connections 419 and 423. In some implementations, the power is regulated. For example, the power for the module 499 could be regulated by a voltage regulator and is depicted in this example as voltage regulator 424.

The module 499 includes an A/D converter 402 and a multiplexer 403. Then the microcontroller 401 can measure the incoming voltage. In this example, the microcontroller 401 can also measure the voltage over the resistor 418 via the A/D converter 402, the multiplexer 403 and the connections 426, 428, 427. For example, the microcontroller 401 can calculate actual current flowing from the battery 414 for a given voltage and known resistor value for 418. This then enables the microcontroller 401 to calculate and/or report or store current and power as well as more advanced tasks such as indicating servo endpoints, rudder flutter etc. based on analysis of actual current/power and set-point values. These microprocessor results can then be distributed via the CAN network.

While drawn separately, it is readily apparent that an actuator, servo, motor controller or sensor could have a module such as module 499 integrated into it.

Figure 5:
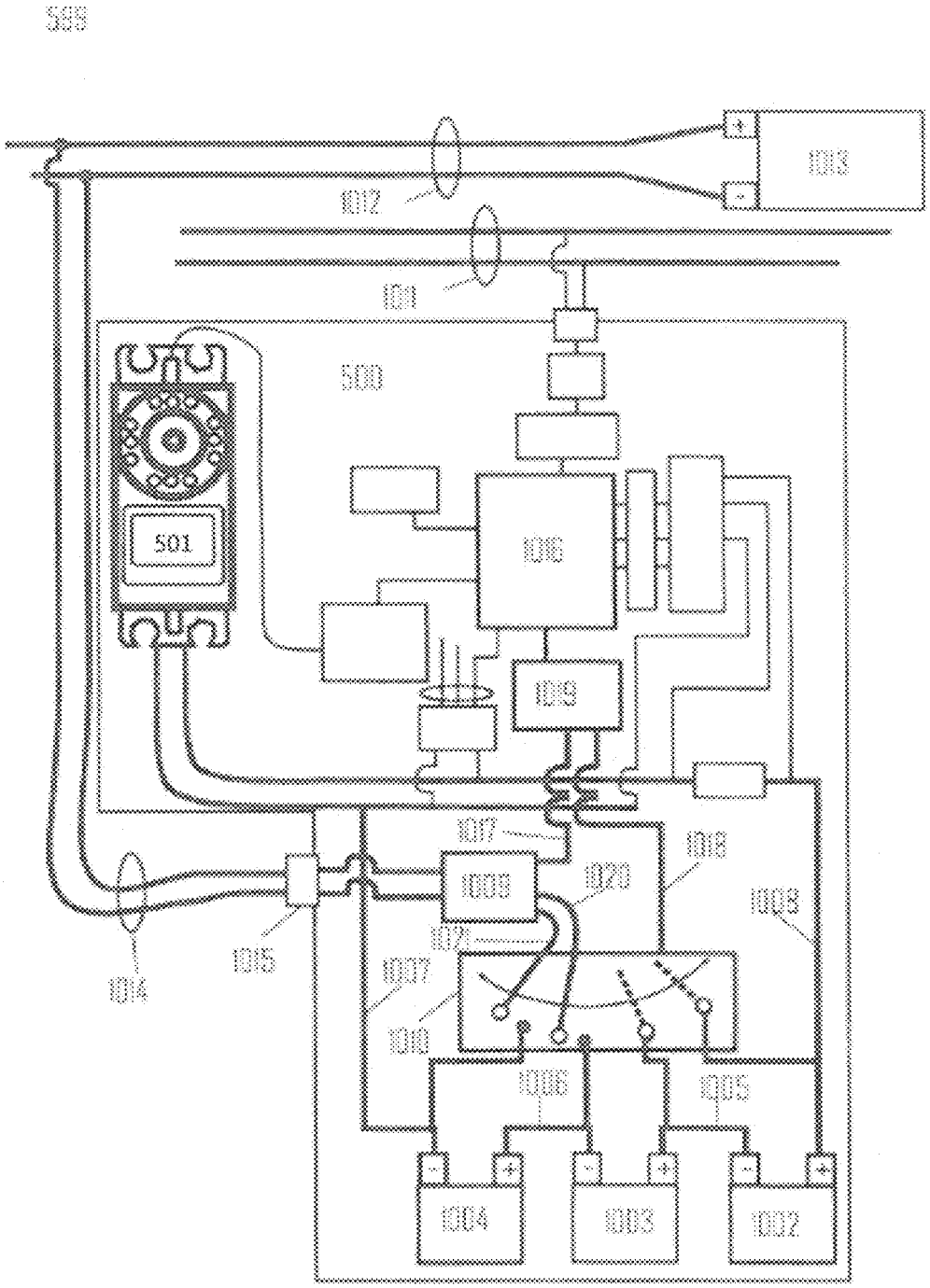
FIG. 5 is a block diagram of an example implementation of a module capable of distributing and regulating power.

FIG. 5 is a block diagram 599 of an example implementation of a module 500 capable of distributing and regulating power. The power requirements for servos and motor controls can vary. For example, servos for common scale models regularly require 7.4 volts but the electric motors for such scale models often require 11.1 or 14.8 volts.

Module 500 represents an integrated servo having its own power supply of three power sources numbered 502, 503, and 504 and a control unit 501. For example, each power source could be a capacitor, or each power supply could be a battery and each could supply a nominal voltage of 3.7V. Through the connections 505 and 506, the power sources are coupled in series giving a nominal voltage of 11.1 V to the module via the connections 507 and 508. In some implementations, the module 500 also has a battery charging unit 509 optimized for charging one battery cell.

In this implementation, each power supply is connected to the multiplexer 510 through the connections 505, 506, and 507. Parallel with the CAN bus 511 is a power line 512 connected to the power source 513. Note that in this implementation, the power source 513 can supply the continuous power for the system while peak current needs can be satisfied through a combination of the power source 513 and the internal power sources 505, 506, and 507. For example, the power source 513 could be a solar cell or a fuel cell or the like while the power sources 505, 506, and 507 could be batteries. This distributed power scheme enables power to be drawn from modules 500 as needed, supplementing the continuous power. As one module 500 internal power sources 505, 506, and 507 are depleted, other module 500 can be called upon to supply power. It should be understood that a single power source or multiple power sources can be made to equate to the drawn three internal power sources 505, 506, 507.

Alternatively, some implementations do not have a continuous power source. Instead, power for the modules 500 and the vehicle come directly from the modules 500 through the described distributed power scheme. The distributed power scheme enables the modules 500 to contribute power as needed and as modules 500 are depleted. Some of these implementations make use of a common power charging interface (not shown), enabling the common recharging of all of the modules 500 within a vehicle. For example, a vehicle can be configured with a common recharging interface.

In this example, the power source 513 delivers power to the battery charger 509 through the connections 514 and 515. In this configuration the microcontroller 516 can control the battery charger 509 and the multiplexer 510 via the digital connections 517 and 518 respectively connected to the digital I/O 519. The multiplexer 510 connects the charger 509 to the power supplies 502, 503 and 504. Note that 520 and 521 are shown for the sake of clarity and represent logical switching by the multiplexer 510. By this design, this implementation enables the microcontroller 516 to monitor the charging status of the power supplies 504, 505 and 506.

Figure 6:
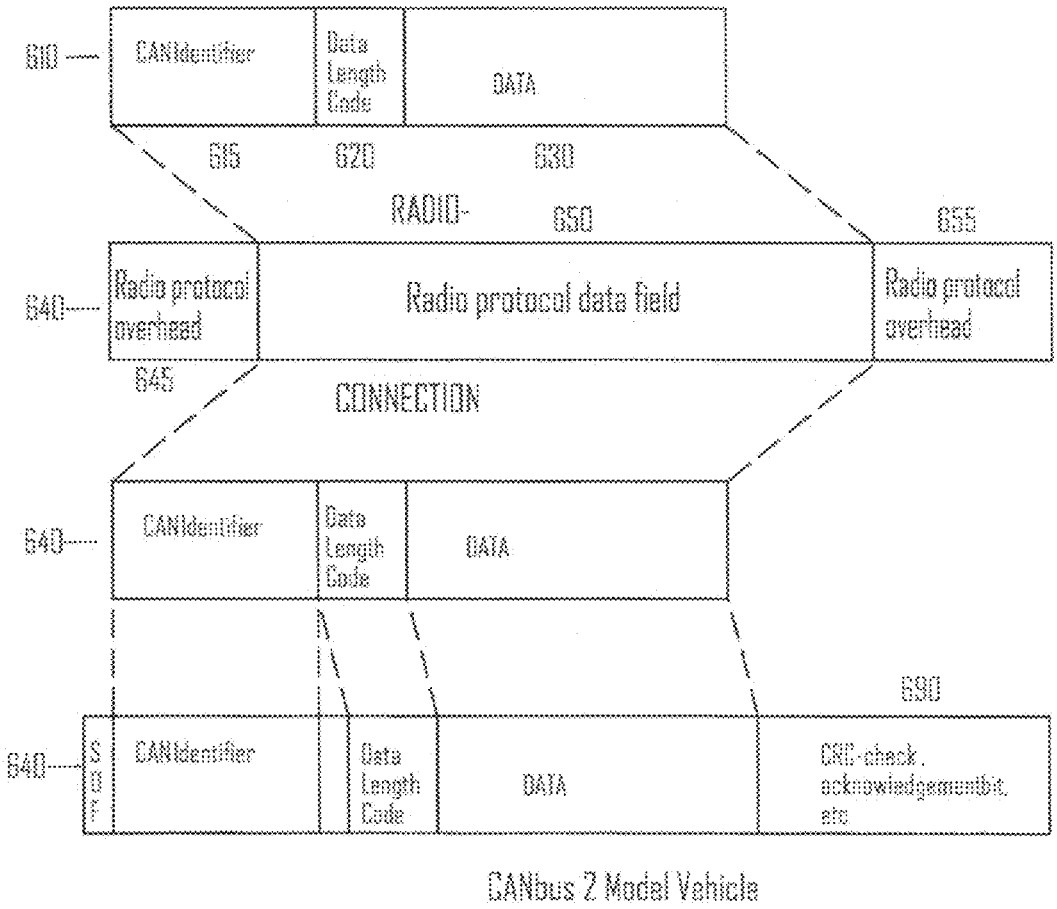
FIG. 6 shows diagrammatically how protocol exchange takes place between the CAN protocol and radio protocol.

FIG. 6 shows diagrammatically how protocol exchange takes place between the CAN-protocol and a radio protocol. A transmitter receives pilot control values and translates those control values into a CAN message 610. The CAN message 610 has a CAN identifier 615, a data length code 620 and a data field 630. The transmitter prepares the CAN message 615 for transmission and transmits the CAN message 615 as radio message 640. The radio message consists of a start protocol 645, a data field 650 which contains the CAN message 615, and an ending protocol 655.

A receiver in the remote vehicle receives the radio message 640 and extracts the received CAN message 660 (not shown in the figure). The receiver then transmits the received CAN message 660 to all of the modules. For example, radio message 640 corresponds to radio protocol information package 301 in FIG. 3. The received CAN message 660 would be transmitted on the bus 310 by receiver 302 to the modules 304, 306, 305, 309, 308, and 307. In some implementations, the receiver adds a start of frame indicator 690 and error detection information 690 to the received CAN message 660 before transmitting the received CAN message 660 to the modules.

Figure 7:
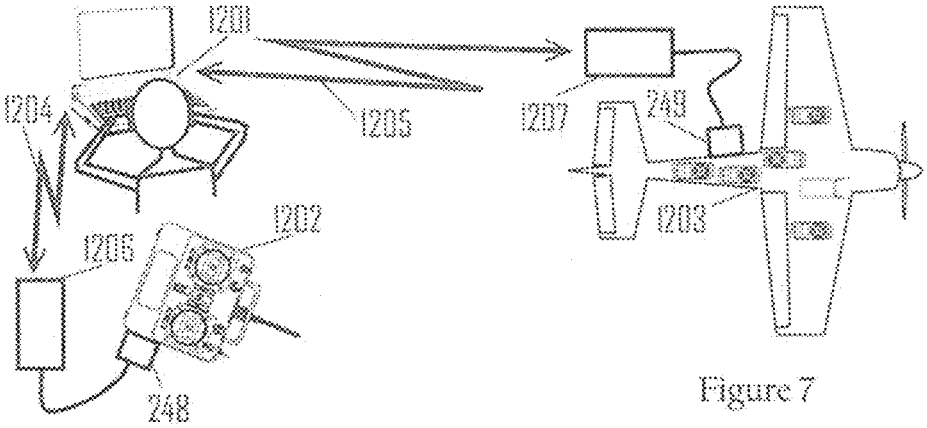
FIG. 7 shows an example implementation of a computer and/or transmitter remote control system implementation for flying scale model.

FIG. 7 shows an example implementation of a computer 1201 and/or transmitter 1202 remote control system 1240 implementation for flying scale model 1203. The network makes use of a CAN-to-WiFi unit 1206 and 1207. The CAN-to-WiFi unit 1206 connects to the CAN connector 248 at the transmitter 1202. As shown, in some implementations the computer 1201 can be operationally connected to the CAN-to-WiFi unit 1206 through a wireless connection 1204. The CAN-to-WiFi unit 1207 connects to the CAN connector 249 at the vehicle 1203. While drawn outside of the vehicle 1203, it should be understood that the CAN-to-WiFi units 1206 and 1207 can be contained within their respective devices. Alternatively, some implementations utilize an Internet hotspot scheme (not shown) where an Internet connection is used to enable a user to send commands at a distance through the internet to the vehicle 1203.

While the subject matter was disclosed using the example of a RC plane, the disclosed subject matter can be applied to and made to work with any vehicle, scale model or full size, that is desired to be remotely controlled. For example, the remotely controlled vehicle could be a RC helicopter, a RC hoover craft, a boat, a blimp, a car, and the like.

Portions of the subject matter and the operations described in this specification can be implemented as a method, in digital electronic circuitry, or in computer software, firmware, or hardware, including the structures disclosed in this specification and their structural equivalents, or in combinations of one or more of them. For example, computer software, ran upon a computer can be used to reprogram the modules or provide new schemes to the modules. Portions of the subject matter described in this specification can be partially implemented as one or more computer programs, i.e., one or more modules of computer program instructions, encoded on computer storage medium for execution by, or to control the operation of, data processing apparatus. Alternatively or in addition, the program instructions can be encoded on an artificially-generated propagated signal, e.g., a machine-generated electrical, optical, or electromagnetic signal, that is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate physical components or media (e.g., multiple CDs, disks, or other storage devices).

Portions of the operations described in this specification can be implemented as operations performed by a data processing apparatus on data stored on one or more computer-readable storage devices or received from other sources.

The term "data processing apparatus" encompasses all kinds of apparatus, devices, and machines for processing data, including by way of example a programmable processor, a computer, a system on a chip, or multiple ones, or combinations, of the foregoing The apparatus can include special purpose logic circuitry, e.g., an FPGA (field programmable gate array) or an ASIC (application-specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

Some of the processes and logic flows described in this specification can be performed by one or more programmable processors executing one or more computer programs to perform actions by operating on input data and generating output. These processes and logic flows can also be performed by, and apparatus can also be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory and/or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, portions of the subject matter described in this specification can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination; the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

I claim:

1. A system of powering a remote controlled vehicle comprising:

a transmitter, the transmitter able to receive vehicle control signals from a user and transmit the vehicle control signals;

a vehicle including:

at least one receiver;

one or more modules, wherein a non-empty subset of the one or more modules is a powered module and a powered module is a module having a power supply distinct from a primary power supply;

a distributed network to which each of the one or more modules is connected;

wherein the distributed network is capable of transmitting power from any module to any other module; and at least one primary power supply, the at least one primary power supply capable of servicing a base line power need of the vehicle.

2. The system of claim 1 wherein the vehicle receiver is able to receive the transmitted vehicle control signals and transmit the vehicle control signals to all of the one or more modules, wherein each of the one or more modules selectively chooses which of the transmitted vehicle control signals the module will respond to.

3. The system of claim 2 wherein a powered module can draw power from its power supply to supply power on an as needed basis to the powered module and other modules.

4. The system of claim 1 wherein the vehicle further includes a power charging interface operationally connected to the primary power supply and operationally connected to each power supply of each powered module.

5. The system of claim 1 wherein the receiver transmits the vehicle control signals in a CAN message format over a CAN network with a bus topology.

6. The system of claim 1 wherein a module can receive and store a scheme.

7. The system of claim 2 wherein the transmitter translates the received vehicle control signals into a CAN message format.

8. The system of claim 2 wherein the CAN bus of the transmitter can be temporarily joined to a CAN bus of the vehicle.

9. The system of claim 2 wherein at least one module has a USB interface.

10. A system of powering a remote controlled aircraft, comprising:

at least one primary power supply capable of powering a remote controlled aircraft; and a remote controlled aircraft, the aircraft further comprising:

at least one receiver for receiving control signals from a transmitter;

at least one module;

at least one powered module having a power supply distinct from the at least one primary power supply;

a distributed network to which the at least one module and the at least one powered module are connected;

wherein the distributed network is capable of transmitting power from any module to any other module; and a transmitter for transmitting the control signals to the aircraft.

11. The system of claim 10, wherein the receiver is a transceiver, and wherein the transceiver is capable of receiving the control signals and transmitting the control signals to each of the at least one modules, wherein each of the at least one modules selects which of the control signals the module will respond to.

12. The system of claim 10, wherein each of the at least one powered module can draw power from its respective power supply to supply power selectively to the at least one powered module and the rest of the at least one modules.

13. The system of claim 10, wherein the aircraft further comprises:

at least one power charging interface operationally connected to the at least one primary power supply and to each respective power supply of each of the at least one powered module.

14. The system of claim 11, wherein the transceiver transmits the control signals in a CAN message format over a CAN network with a bus topology.

15. The system of claim 10, wherein a module is configured to receive and store a scheme.

16. The system of claim 10, wherein the receiver translates the received control signals into a CAN message format.

17. The system of claim 11, wherein the CAN bus of the transceiver is capable of being temporarily joined to a CAN bus of the vehicle.

18. The system of claim 10, wherein the at least one module has a USB interface.

19. A system of powering a remote-controlled vehicle, comprising:

a primary power supply for powering the remote-controlled vehicle;

a vehicle further comprising:

a vehicle transceiver for receiving and sending vehicle control signals;

a plurality of modules, wherein at least one of the plurality of modules is at least one powered module, and wherein the at least one powered module comprises a power supply distinct from the primary power supply; and a distributed network to which at least two of the plurality of modules are connected in electrical communication, wherein the distributed network is selectively energizable to transmit power between any of the at least two of the plurality of modules in electrical communication.

20. The system of claim 19, wherein each of the at least one powered module can draw power from its respective power supply to supply power selectively to any of the plurality of modules.

* * * * *